US005435100A

United States Patent [19]

Kuisis

[11] Patent Number: 5,435,100

[45] Date of Patent: Jul. 25, 1995

[54] TURNSTILE CONTROL MECHANISM

[76] Inventor: Gerald Kuisis, P.O. Box 783052, Sandton, 2146, Transvaal, South Africa

[21] Appl. No.: 192,397

[22] Filed: Feb. 4, 1994

[30] Foreign Application Priority Data

Feb. 4, 1993 [ZA] South Africa ..... 93/0767

[51] Int. Cl.[6] ..... E06B 11/08

[52] U.S. Cl. ..... 49/46; 474/135

[58] Field of Search ..... 49/46, 47, 42, 35, 49; 474/135, 134

[56] References Cited

U.S. PATENT DOCUMENTS

| | | | |
|---|---|---|---|
| 976,115 | 11/1910 | Bard | 474/135 X |
| 2,954,726 | 10/1960 | Kerridge | 474/135 X |
| 3,525,176 | 8/1970 | Collins | 49/46 |
| 3,795,075 | 3/1974 | Orzechowski | 49/46 |
| 3,978,613 | 9/1976 | Hayward et al. | 49/46 |
| 5,146,711 | 9/1992 | Gallenschutz et al. | 49/46 |

FOREIGN PATENT DOCUMENTS

| | | | |
|---|---|---|---|
| 2186618 | 8/1987 | United Kingdom | 49/46 |

*Primary Examiner*—Philip C. Kannan

*Attorney, Agent, or Firm*—Popham, Haik, Schnobrich & Kaufman Ltd.

[57] ABSTRACT

A control mechanism is provided for a turnstile of the type comprising a plurality of arms which meet at a central hub and are rotatable on a rotational axis. The turnstile is adapted to stop in a position with an arm forming a barrier across a passageway and is operable to rotate through an arc defined by the angle between adjacent arms when the control mechanism is actuated to allow a person to pass through the passageway. The control mechanism comprises a first gear wheel adapted to be mounted to the turnstile to rotate therewith on the rotational axis of the turnstile, and second gear wheel adapted to be driven by the first gear wheel. A drive means connects the first and second gear wheels together, and a release mechanism is adapted to co-act with the second gear wheel to releasably lock the second gear wheel against rotation each time said turnstile has rotated through the arc. An actuating mechanism is adapted to operate the release mechanism. Preferably the drive means comprises an endless chain which passes around the two gear wheels keeping the two gear wheels in registry with each other.

10 Claims, 3 Drawing Sheets

TURNSTILE CONTROL MECHANISM

BACKGROUND TO THE INVENTION

This invention relates to a turnstile control mechanism of the type which permits single person access through the turnstile on the actuation of a release mechanism but which will bar access to further persons passing through the turnstile until the release mechanism is again actuated.

Most turnstile control mechanisms would operate satisfactorily if they were permitted to operate without significant pressure being applied to the turnstile arms. However, this is usually not the case and persons pressing on the turnstile arms tend to apply a significant load to the release mechanism. Damage can be caused to the mechanism, particularly when a load is being applied to the arms at the same time as the release mechanism is being operated.

Most turnstile control mechanisms include a hub fixed to rotate with the turnstile arms and some form of release mechanism which is engagable with or disengagable from the hub. The diameter of the hub is generally significantly less than the diameter of the rotational arc of the outer ends of the turnstile arms. Thus, due to the principle of mechanical advantage, the load applied to the release mechanism is significantly larger than the load applied to the arms by the person pressing against the arms. Where the release mechanism comprises a solenoid or like electrically operated release catch it will need to be relatively powerful to overcome the load applied to it in this manner. It is often found that the release mechanism will fail over a period of time.

A further problem with prior art turnstile mechanism is that the rotation of the turnstile is not damped in any significant manner. Thus, where persons are passing through the turnstile rotate the turnstile arms on their way through, the release mechanism is placed under undue strain as it clicks into its locked position. This too can result in early failure of the control mechanism.

SUMMARY OF THE INVENTION

According to the invention there is provided a control mechanism for a turnstile of a type comprising a plurality of arms which meet at a central hub and are rotatable on a rotational axis, the turnstile being adapted to stop in a position with an arm forming a barrier across a passageway and being operable to rotate through an arc defined by the angle between adjacent arms when the control mechanism is actuated to allow a person to pass through the passageway, said control mechanism comprising, a first gear wheel adapted to be mounted to the turnstile to rotate therewith on the rotational axis of the turnstile, a second gear wheel adapted to be driven by the first gear wheel, drive means connecting the first and second gear wheels together, a release mechanism adapted to co-act with the second gear wheel to releasably lock the second gear wheel against rotation each time said turnstile has rotated through said arc, and an actuating mechanism adapted to operate the release mechanism.

Preferably the drive means comprises an endless chain which passes around the two gear wheels keeping the two gear wheel is registry with each other. The number of teeth on the second gear wheel is preferably a factor of the number of teeth on the first gear wheel, the gearing being such that rotation of the turnstile through said arc would cause a full 360° revolution of the second gear wheel. Thus, if the turnstile has four arms, the first gear wheel will have four times the number of teeth of the second gear wheel. If the turnstile has three arms the first gear wheel will have three times the number of teeth of the second gear wheel.

The release mechanism may comprise a locking formation or locking are mounted on the second gear wheel to rotate therewith, and a releasable catch mounted adjacent the second gear wheel for engagement with one end of the locking formation or locking arm each time the locking formation or locking arm passes through a full revolution. The opposite end of the arm may be configured to serve as a non-return device which will be adapted to prevent the reversal of the turnstile after it has passed through half of said arc. Damping means may be incorporated into the control mechanism. The damping means may comprise one or more wheels or cogs engagable with said chain.

The control mechanism may include biasing means for biasing the turnstile into said position in which an arm forms a barrier across said passageway. The biasing means may comprise a spring adapted to urge the turnstile into said position. The spring may act on a crank mounted on a second gear wheel, the spring adapted to bias the crank and hence the second gear wheel to a rest position which corresponds to said position in which an arm forms a barrier across the passageway. The spring may comprise a gas spring.

These and further features of the invention will be made apparent from the description of preferred embodiment thereof given below by way of example. In the description reference is made to the accompanying drawings. The drawing, however, are merely illustrative of how the invention might be put into effect, so that the specific form and arrangement of the various features shown is not to be understood as limiting on the invention.

DETAILED DESCRIPTION

Figure 1:
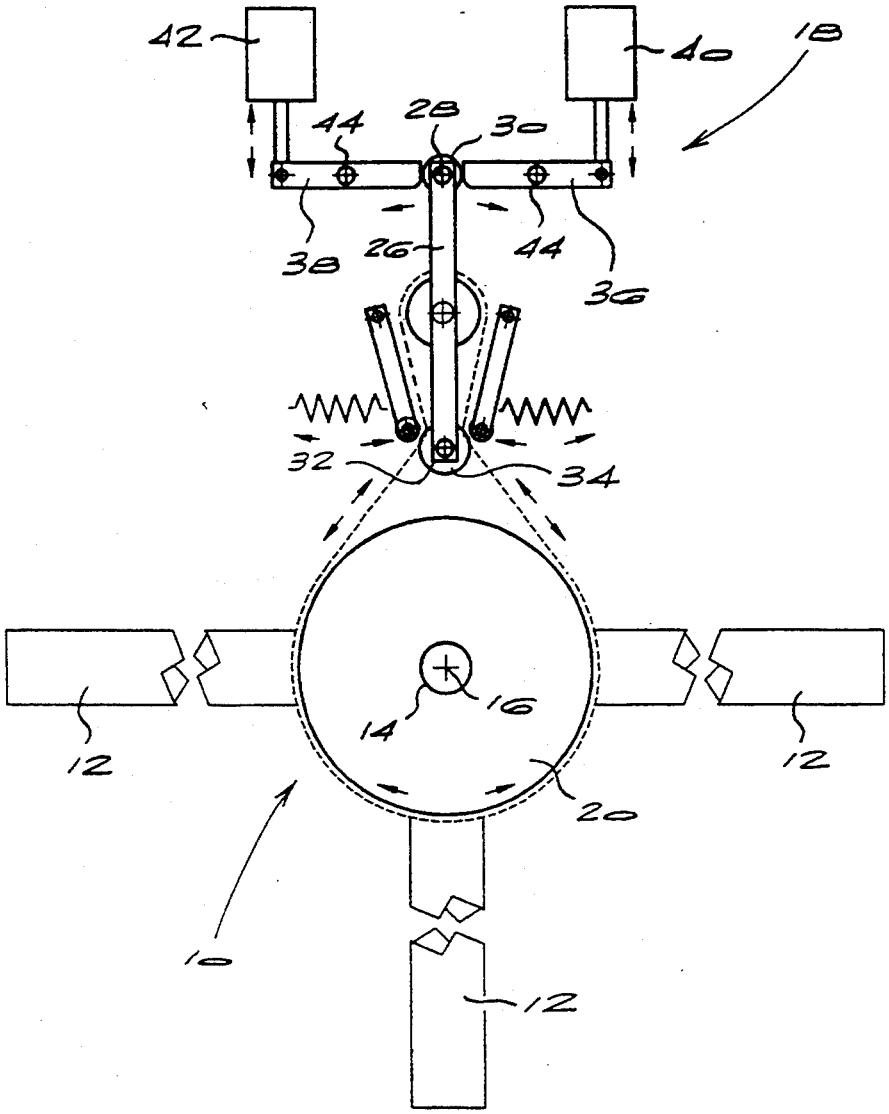
FIG. 1 shows diagrammatically in plan view a turnstile and control mechanism therefor according to the invention.

Referring initially to FIG. 1, a turnstile 10 comprises four evenly spaced arms 12 (one of which has been omitted in the drawings for purposes of clarity) joined to a central hub 14. The turnstile is rotatable on a rotational axis 16 in conventional fashion. The turnstile 10 will be arranged in a passageway (not shown) and in that passageway one of the arms 12 will form a barrier against persons passing through the passageway until such time as a control mechanism indicated at numeral 18 has released the turnstile for rotation. The turnstile 10 is able to rotate in either direction of rotation although in most instances, the control mechanism 18 will be adapted to allow rotation in only one direction. However, the control mechanism is able to rotate with rotation in either direction.

A first gear wheel or sprocket 20 is mounted for rotation with the turnstile 10. The gear wheel 20 is of relatively large diameter. A second gear wheel or sprocket 22 is mounted adjacent to the first gear wheel 20 on a parallel axis of rotation. A drive chain 24 connects the first and second gear wheels together. The second gear wheel 22 is of relatively small diameter so that rotation of the turnstile 10 through a small arc will cause the gear wheel 22 to rotate through a large arc. The number of gear teeth on the large gear wheel 20 will be four times the number of teeth on the small gear wheel 22 so that rotation of the gear wheel 20 through 90° will cause the gear wheel 22 to rotate through 360°. The ration of the gear wheels 20 to 22 will be the same as the number of arms 12 on the turnstile 10.

The gear wheel 22 has a locking formation or locking arm 26 mounted thereto for rotation therewith. The locking arm 26 has a first end 28 with a small diameter roller 30 mounted thereto. The second end 32 of the arm 26 has a large diameter roller 34 fitted thereto. Rotation of the arm 26, and hence the gear wheels 22 and 20 is prevented by a pair of locking pawls numbered 36 and 38. Those two locking pawls prevent the arms 26 rotating in opposite directions. The locking pawl 36 is controlled by a solenoid 40 and the locking pawl 38 is controlled by a solenoid 42. The locking pawls 36 and 38 are pivotable about pivot points 44. To release the turnstile 10 for rotation either one of the locking pawls 36 or 38 must be released from engagement with the roller 30 to allow the arm 26 to rotate and hence the gear wheel 22 and gear wheel 20 to rotate.

Figure 2:
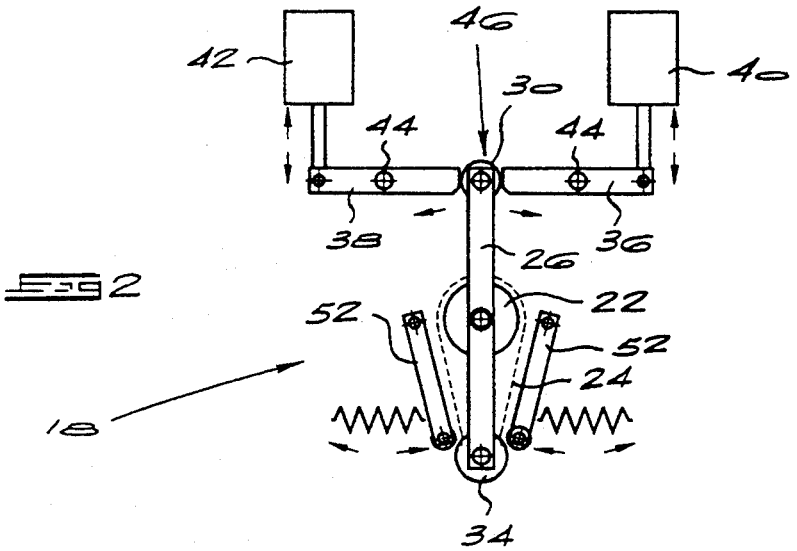
FIG. 2 to 4 show the control mechanism depicted in FIG. 1 in various positions during operation of the turnstile.
Figure 3:
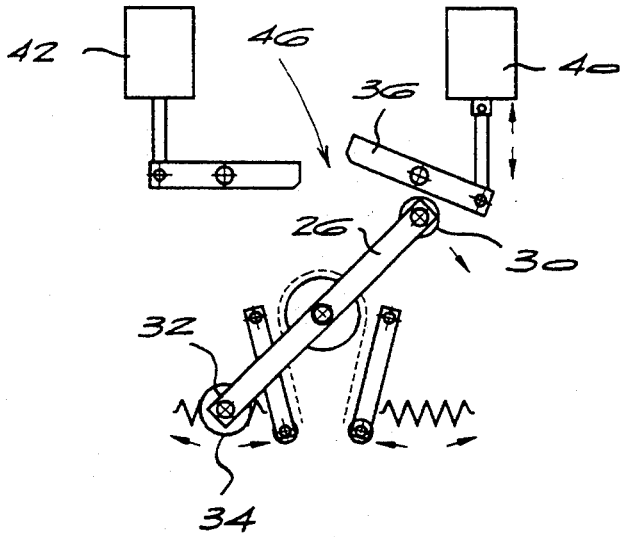
Figure 4:
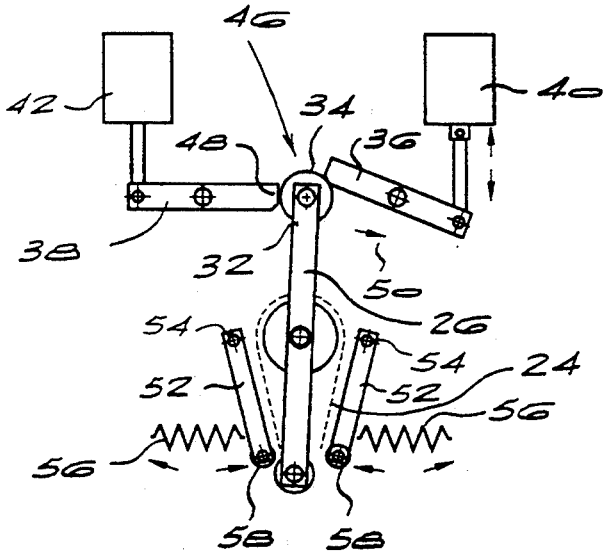

The manner of operation of control mechanism 18 in shown in FIGS. 2 to 4 of the drawings. FIG. 2 shows the control mechanism 18 in its locked position. FIG. 3 shows the mechanism in its just released condition. Release of the turnstile could be achieved by some electronic device such as a card reader or the like, a release button, or a coin actuated mechanism for example. As shown in FIG. 3 actuation of the solenoid 40 has caused the locking pawl 36 to life up allowing the arm 26 to clear the pawl and begin its rotational arc. A timer device (not shown) will be used to hold the pawl 36 in that lifted condition until such time as the end 32 of the arm 26 reaches the gap 46 between the two locking pawls 36 and 38. The solenoid 40 will hold the locking pawl 36 in its raised condition until the arms 12 on the turnstile have moved through 45°, that is through half of the arc they will move for each operational cycle.

That half-way condition is the condition shown in FIG. 4. In that condition the end 32 of the arm 26 will have moved into the gap 46 and the large diameter roller 34 will have moved past the end 48 of the locking pawl 38. In that condition the arm 26 will be prevented by rotating in the reverse direction due to the engagement of the roller 34 on the end 48 of locking pawl 38. It will be noted, however, that due to the fact that the roller 34 is of large diameter, the pawl 36 cannot return to its at-rest condition and therefore the arm 26 cannot be locked in its midway position, (i.e. the position indicated in FIG. ). The arm 26 will, however, still be able to rotate in the direction of arrow 50 so as to enable it to complete the operational cycle of the turnstile. The purpose of this arrangement is to prevent the turnstile 10 being moved back and forward in its intermediate position thereby permitting persons to move or squeeze past the arms 12 without operating the control mechanism 18.

It will be noted that the locking pawls 36 and 38 and solenoids 40 and 42 are identical to each other so that the control mechanism can be caused to operate in exactly the reverse of the sequence mentioned above. Thus, the turnstile can be used both as an entry barrier and an exit barrier if required.

It will be appreciated that once the end 28 of the locking arm 26 moves into the gap 46, i.e. back to the FIG. 2 position, the turnstile will again be locked in position requiring operation of the release mechanism in order to allow a further person to pass through the barrier.

As has previously been mentioned, it is important that rotation of the turnstile 10 is damped. A convenient method of damping the mechanism described herein is to apply a damping force to the chain 24. A pair of spring loaded damping arms 52 are provided on opposite sides of the chain. Those damping arms 52 are pivotable about pivot points 54 and are spring loaded by compression springs 56 against the chain 24. A roller or small sprocket 58 is provided on the free end of the arms 52 and those rollers 58 will be in contact with the chain 24 to provide the damping effect. Clearly the degree of damping will depend on the spring force provided by springs 56 which can be adjustable if necessary.

It will be appreciated that a relatively low force will be provided on solenoids 40 and 42 even if a high pressure is being applied to the arms 12. Firstly, the force applied to the solenoids 40 and 42 will be applied in a direction with is transverse to the direction of operation of the solenoids. This transverse force will be carried by the pivots 44 and not the solenoids. Secondly, due to the arrangement of the gear wheels 20 and 22 and, the effect of the gear ratios of gear wheels 20 and 22, the force applied to the pawls 36 and 38 by the arm 26 will be relatively slight. It is thus envisaged that the problems previously referred in relation to the difficulty of having the release mechanism operate when under load will be minimized.

Figure 5:
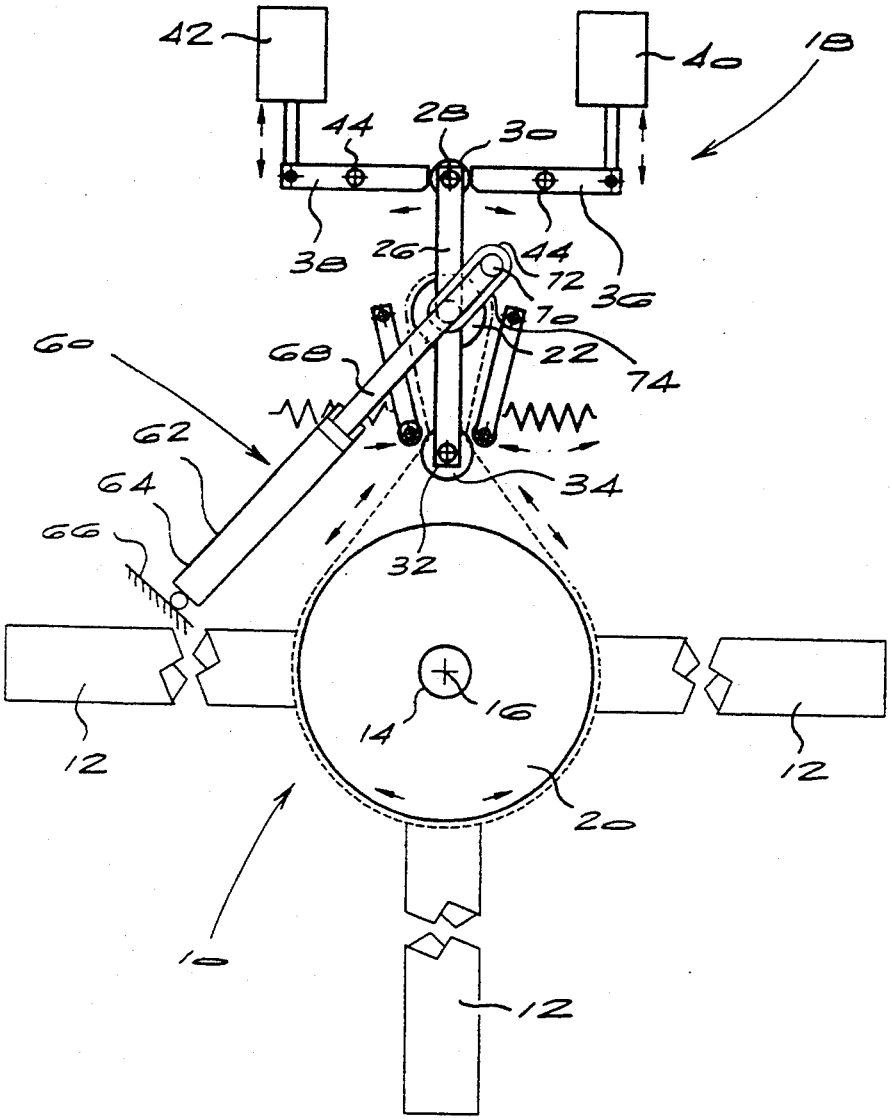
FIG. 5 shows a similar view to that of FIG. 1 but with a biasing means fitted to the control mechanism.

As shown in FIG. 5, a biasing means 60 may be fitted to the control mechanism to bias the control mechanism into a position in which one of the arms 12 forms a barrier across the passageway in which the turnstile is installed. The biasing means 60 comprises a gas spring 62 which includes a cylinder 64 which is pivotally mounted to a suitable mount 66, and a piston 68. The free end 70 of the piston is rotationally mounted to the radially outer end 72 of a crank 74 which is fixed to rotate with the gear wheel 22.

In the position shown in FIG. 5 the gas spring 62 is in its fully extended (ie at rest) position with the piston 68 aligned with the crank arm 74. Rotation of the wheel 22 (and hence the crank arm 74) in either direction will tend to force the piston into the cylinder 64 compressing the gas in the cylinder. Thus, if the turnstile arms 12 are released when the arms 12 are in a non-barrier or intermediate position the gas spring 62 will act on the crank arm 74 to rotate the wheel 22 back to its locked position, that is, the position where the roller 30 is located between the pawls 36 and 38.

Various alterations may be made to the above described embodiment without departing from the scope of the invention. For example, the chain 24 may be replaced by a gear train. Alternatively, the first gear wheel may be in direct intermeshed engagement with the second gear wheel in which case the "drive means" will comprise the intermeshed gear teeth. In addition, the configuration of the locking formation or locking arm 26 may differ to that described herein and the arrangement of the solenoids or other catch device can be quite different from that described herein. Also, as previously mentioned, where a fewer or greater number of arms 12 are provided on the turnstile the gear ratios between the gears 20 and 22 will need to be different.

I claim:

1. A control mechanism for a turnstile of a type comprising a plurality of arms which meet at a central hub and are rotatable on a rotational axis, the turnstile being adapted to stop in a position with an arm forming a barrier across a passageway and being operable to rotate through an arc defined by the angle between adjacent arms when the control mechanism is actuated to allow a person to pass through the passageway, said control mechanism comprising a first gear wheel adapted to be mounted to the turnstile to rotate therewith on the rotational axis of the turnstile, a second gear wheel adapted to be driven by the first gear wheel, drive means connecting the first and second gear wheels together, a release mechanism adapted to co-act with the second gear wheel to releasably lock the second gear wheel against rotation each time said turnstile has rotated through said arc, an actuating mechanism adapted to operate the release mechanism, the release mechanism comprising a locking formation fixed to rotate with the second gear wheel, and a releasable catch mounted adjacent of the second gear wheel for engagement with the locking formation each time the second gear wheel rotates through a full revolution.

2. A control mechanism according to claim 1 wherein the locking formation comprises a locking arm mounted on the second gear wheel to rotate therewith, the releasable catch being arranged and positioned for engagement with one end of the locking arm each time the second gear wheel rotates through a full revolution.

3. A control mechanism according to claim 1, wherein the locking arm has an opposite end which is configured to engage with said releasable catch as the second gear wheel rotates through half of a full revolution, the releasable catch including a non-return device thereon which, when said second gear wheel has rotated through half of a full revolution, will interact with said opposite end to prevent reverse rotation of the turnstile.

4. A control mechanism according to claim 3, wherein both ends of the locking arm carry a respective roller, and the releasable catch comprises a pair of pivotable locking pawls which are spaced apart a selected distance, the roller on said one end having a diameter which is less than said selected distance, and the roller on the opposite end having a diameter which is greater than said selected distance.

5. A control mechanism according to claim 1 wherein the drive means comprises and endless chain which passes around the two gear wheels keeping the two gear wheels in registry with each other.

6. A control mechanism according to claim 5 wherein the chain is held taught and in engagement with the first and second gear wheels by a clamping means.

7. A control mechanism according to claim 1 wherein the number of teeth on the second gear wheel is a factor of the number of teeth on the first gear wheel, the gear rations being selected such that rotation of the turnstile through said arc will cause a full 360° revolution of the second gear wheel.

8. A control mechanism according to claim 7 wherein the first gear wheel has four times as many gear teeth as the second gear wheel and the control mechanism is adapted to be mounted to a turnstile having four arms.

9. A control mechanism for a turnstile of a type comprising a plurality of arms which meet at a central hub and are rotatable on a rotational axis, the turnstile being adapted to stop in a position with an arm forming a barrier across a passageway and being operable to rotate through an arc defined by the angle between adjacent arms when the control mechanism is actuated to allow a person to pass through the passageway, said control mechanism comprising a first gear wheel adapted to be mounted to the turnstile to rotate therewith on the rotational axis of the turnstile, a second gear wheel adapted to be driven by the first gear wheel, drive means connecting the first and second gear wheels together, a release mechanism adapted to co-act with the second gear wheel to releasably lock the second gear wheel against rotation each time said turnstile has rotated through said arc, an actuating mechanism adapted to operate the release mechanism, and a biasing means for biasing the turnstile into said position in which an arm forms a barrier across said passageway, said biasing means comprising a spring adapted to urge the turnstile into said position, the spring acting on a crank fixed to rotate with the second gear wheel, said spring urging the crank to a rest position which corresponds to the position of a turnstile in which an arm forms a barrier across the passageway.

10. A control mechanism according to claim 9 wherein the spring is a gas spring.

* * * * *